US009845622B2

(12) United States Patent
Brose et al.

(10) Patent No.: US 9,845,622 B2
(45) Date of Patent: Dec. 19, 2017

(54) MOTOR VEHICLE LOCK ARRANGEMENT

(75) Inventors: Simon Brose, Hattingen (DE); Roman Joschko, Dormagen (DE); David Rosales, Rochester Hills, MI (US); Ihsan Alisan, Hagen (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 1228 days.

(21) Appl. No.: 12/978,479

(22) Filed: Dec. 24, 2010

(65) Prior Publication Data

US 2011/0181052 A1 Jul. 28, 2011

(30) Foreign Application Priority Data

Dec. 26, 2009 (DE) ..... 20 2009 017 667 U

(51) Int. Cl.
*E05C 3/16* (2006.01)
*E05B 77/06* (2014.01)
*E05B 15/04* (2006.01)

(52) U.S. Cl.
CPC ..... *E05B 77/06* (2013.01); *E05B 2015/0496* (2013.01); *Y10T 292/0908* (2015.04)

(58) Field of Classification Search
CPC ..... E05B 77/02; E05B 77/04; E05B 77/06; E05B 15/01; E05B 15/043;
(Continued)

(56) References Cited

U.S. PATENT DOCUMENTS 3,992,909 A 11/1976 Mcghee et al.
4,080,812 A 3/1978 Knott et al.
(Continued)

FOREIGN PATENT DOCUMENTS

DE 4117110 C1 * 12/1992
DE 19511651 10/1995
(Continued)

OTHER PUBLICATIONS

European Search Report for corresponding European Patent Application No. 10016238, mailed Sep. 17, 2015 (4 pages).
(Continued)

*Primary Examiner* — Alyson M Merlino
(74) *Attorney, Agent, or Firm* — Pauly, DeVries, Smith & Deffner LLC

(57) ABSTRACT

Described herein is a motor vehicle lock arrangement that includes a motor vehicle lock, with an operable functional element and a securing device which is associated with the functional element, wherein the securing device is coupled or it being possible to couple the securing device to the functional element in order to counteract an automatic operating movement of the functional element due to a crash acceleration phenomena which can occur in the event of a crash. In one embodiment, the securing device has a deflectable blocking element which can be deflected into a blocking position in which an operating movement of the functional element can be blocked by the blocking element, and the blocking element has an associated latching arrangement which latches in when the blocking element is deflected into the blocking position, and the latched-in latching arrangement holds the blocking element in the blocking position.

9 Claims, 8 Drawing Sheets

(58) Field of Classification Search
CPC ..... E05B 15/0406; E05B 15/041; E05B 15/0417; E05B 15/0496; E05B 2015/0496
USPC ..... 292/201, 216, DIG. 23, DIG. 65, 92, 292/336.3, DIG. 22
See application file for complete search history.

(56) References Cited

U.S. PATENT DOCUMENTS

| | | | | |
|---|---|---|---|---|
| 4,155,233 | A | 5/1979 | Lira et al. | |
| 4,441,236 | A | 4/1984 | Bron et al. | |
| 4,616,862 | A | 10/1986 | Ward et al. | |
| 5,865,481 | A | 2/1999 | Buschmann | |
| 6,042,159 | A | 3/2000 | Spitzley et al. | |
| 6,099,052 | A | 8/2000 | Spitzley et al. | |
| 6,464,270 | B1 | 10/2002 | Grahn et al. | |
| 7,597,368 | B2 * | 10/2009 | Savant | E05B 77/06 292/336.3 |
| 8,056,944 | B2 * | 11/2011 | Jankowski et al. | 292/216 |
| 8,152,209 | B2 | 4/2012 | Lee et al. | |
| 8,322,077 | B2 * | 12/2012 | Papanikolaou et al. | 49/460 |
| 8,414,038 | B2 | 4/2013 | Mason et al. | |
| 9,593,512 | B2 | 3/2017 | Rosales et al. | |
| 9,611,675 | B2 | 4/2017 | Wittelsbuerger et al. | |
| 2003/0057698 | A1 | 3/2003 | Parrott et al. | |
| 2003/0080572 | A1 | 5/2003 | So et al. | |
| 2003/0234544 | A1 * | 12/2003 | Jankowski et al. | 292/220 |
| 2004/0251693 | A1 | 12/2004 | Schoen et al. | |
| 2007/0120382 | A1 | 5/2007 | Chevalier et al. | |
| 2009/0243307 | A1 * | 10/2009 | Lee | 292/93 |
| 2009/0309374 | A1 * | 12/2009 | Lennhoff et al. | 292/92 |
| 2009/0322105 | A1 * | 12/2009 | Lee et al. | 292/237 |
| 2010/0109350 | A1 | 5/2010 | Gschweng et al. | |
| 2010/0207404 | A1 * | 8/2010 | Corwin et al. | 292/336.3 |
| 2011/0062747 | A1 | 3/2011 | Teramoto et al. | |
| 2011/0084505 | A1 * | 4/2011 | Brose et al. | 292/198 |
| 2011/0115252 | A1 | 5/2011 | Higgins et al. | |
| 2011/0258935 | A1 | 10/2011 | Heller et al. | |
| 2011/0259061 | A1 * | 10/2011 | Brose et al. | 70/237 |
| 2013/0140831 | A1 | 6/2013 | Kempel et al. | |
| 2014/0284940 | A1 | 9/2014 | Rosales et al. | |
| 2014/0292005 | A1 | 10/2014 | Bendel et al. | |
| 2014/0312630 | A1 | 10/2014 | Bendel et al. | |
| 2015/0337566 | A1 | 11/2015 | Wittelsbuerger et al. | |
| 2016/0097223 | A1 | 4/2016 | Rosales et al. | |

FOREIGN PATENT DOCUMENTS

| | | | | |
|---|---|---|---|---|
| DE | 10114965 | | 10/2002 | |
| DE | 202006011206 | | 1/2008 | |
| DE | 102008036356 | * | 12/2009 | |
| DE | 102008063318 | * | 12/2009 | |
| DE | 202011002154 | | 6/2012 | |
| DE | 202012002175 | U1 * | 6/2013 | E05B 77/06 |
| EP | 0684357 | | 11/1995 | |
| EP | 1050640 | | 11/2000 | |
| EP | 1052355 | | 11/2000 | |
| EP | 2636826 | A2 * | 9/2013 | E05B 77/06 |
| EP | 2636827 | A2 * | 9/2013 | E05B 77/06 |
| FR | 2876135 | A1 * | 4/2006 | |
| GB | 1324131 | | 7/1973 | |
| GB | 2432184 | | 5/2007 | |
| WO | 2014019960 | | 2/2014 | |

OTHER PUBLICATIONS

German Search Report for German Patent Application No. 10 2015 108 203.9 (priority to U.S. Appl. No. 14/554,624) mailed May 24, 2016 (7 pages).
Extended European Search Report for European Patent Application No. 15179233 related to co-pending U.S. Appl. No. 14/815,590 dated Dec. 22, 2015 (7 pages).
Non-Final Office Action for U.S. Appl. No. 14/815,590, dated May 3, 2016 (15 pages).
Non-Final Office Action for U.S. Appl. No. 14/554,624, dated May 3, 2016 (15 pages).
Notice of Allowance for U.S. Appl. No. 14/554,624 dated Dec. 12, 2016 (11 pages).
Notice of Allowance for U.S. Appl. No. 14/815,590 dated Dec. 2, 2016 (10 pages).

* cited by examiner

MOTOR VEHICLE LOCK ARRANGEMENT

CROSS-REFERENCE TO RELATED APPLICATIONS

This application claims priority to German Utility Model 20 2009 017 667, by Brose Schließsysteme GmbH & Co. KG, filed Dec. 26, 2009, the disclosure of which is incorporated by reference herein in its entirety.

FIELD OF THE INVENTION

The invention relates to a motor vehicle lock arrangement. In particular, the invention relates to a motor vehicle lock arrangement with an operable functional element and a securing device which is associated with the functional element being provided, the said securing device being coupled or it being possible to couple said securing device to the functional element in order to counteract an automatic operating movement of the functional element due to crash acceleration phenomena which occur in the event of a crash.

The motor vehicle lock arrangement under discussion is equipped with a motor vehicle lock in any case. The motor vehicle lock arrangement is routinely also equipped with at least one door handle, in particular with an internal door handle and/or an external door handle, in order to be able to open the motor vehicle lock by corresponding user operation. The term "motor vehicle lock" includes all types of door, bonnet or flap locks.

BACKGROUND

Motor vehicle locks are expected to not malfunction even in the case of high crash acceleration phenomena which occur in the event of a crash. In this case, it is primarily necessary to ensure that the doors of the motor vehicle do not spring open during the crash. This is often the case since, for example, a side impact can lead to an external door handle "staying put" to a certain extent on account of its mass inertia, this altogether leading to a relative movement between the external door handle and the vehicle lock. The result is an operating process which takes place automatically on account of the crash acceleration phenomena and is, of course, undesirable.

In order to counteract an undesired, automatic operating movement of a functional element, such as a door handle of the motor vehicle lock arrangement, a securing device is routinely associated with the motor vehicle lock arrangement.

In one known motor vehicle lock arrangement (DE 20 2006 011 206 U1), the securing device is associated with a Bowden cable between an external door handle and a motor vehicle lock. The securing device consists of a damping element which is in the form of a pneumatic impact damper. The above securing device has the advantageous feature that it functions independently of the direction of the respective crash acceleration phenomenon. One disadvantage is that this securing device is associated with a certain amount of structural outlay on implementation.

Other securing devices for motor vehicle lock arrangements (DE 196 24 640 C1) use a deflectable blocking element for blocking the functional element in question in the event of a crash. The motor vehicle lock of this motor vehicle arrangement is equipped with the customary locking elements, latch and pawl, and also with an operating mechanism. The operating mechanism has an external operating lever which is fitted with the blocking element. In the event of a side impact, crash acceleration phenomena act directly on the blocking element and move the blocking element against the force of a spring, as a result of which the operation of the external operating lever is temporarily blocked. After the crash acceleration phenomena disappear, the blocking element returns to its inoperative position by virtue of a spring load, so that operation by the user is again possible. The disadvantage of an arrangement of this kind is that the functioning of the securing device is dependent on the direction of the respective crash acceleration phenomenon.

SUMMARY

The invention is based on the problem of designing and developing the known motor vehicle lock arrangement in such a way that the functioning of the securing device is ensured with a low level of structural outlay.

In the case of a motor vehicle lock arrangement having a motor vehicle lock, with an operable functional element and a securing device which is associated with the functional element being provided, said securing device being coupled or it being possible to couple said securing device to the functional element in order to counteract an automatic operating movement of the functional element due to crash acceleration phenomena which occur in the event of a crash, the above problem is solved by features in which the securing device has a deflectable blocking element which can be deflected into a blocking position in which an operating movement of the functional element can be blocked by the blocking element, in that the blocking element has an associated latching arrangement which latches in when the blocking element is deflected into the blocking position, and in that the latched-in latching arrangement holds the blocking element in the blocking position.

It one embodiment, the securing device has a deflectable blocking element which can be deflected into a blocking position in which an operating movement of the functional element can be blocked by the blocking element, that the blocking element has an associated latching arrangement which latches in when the blocking element is deflected into the blocking position, and that the latched-in latching arrangement holds the blocking element in the blocking position.

In another embodiment, a first operating movement of the functional element, which operating movement is caused by the crash acceleration phenomena, is itself used to deflect a blocking element into a blocking position against a prestress and therefore to block the continued operating movement of the functional element.

While, according to the further teaching, the use of the first crash-induced operating movement of the functional element ensures a high degree of functional reliability independently of the direction of the respective crash acceleration phenomenon, the use of a deflectable blocking element additionally results in a robust and extremely compact structural design.

Specifically, according to the further teaching of the blocking element, the blocking element is preferably coupled to the functional element at least in a movement region of the functional element by means of a coupling arrangement in such a way that an operating movement of the functional element causes a deflection movement of the blocking element against its prestress in the direction of the blocking position by means of the coupling arrangement. This is not a problem for the operating movement in accordance with normal operation since the arrangement is made such that the resulting deflection movement in accordance with normal operation does not lead to the blocking position. The deflection rate of the blocking element in accordance with normal operation is still so low here that the mass inertia of the blocking element does not play a role.

A different situation arises in the event of a crash in which high crash acceleration phenomena can act, it being possible for these high crash acceleration phenomena to lead to an automatic operating movement of the functional element and therefore to a deflection movement of the blocking element at a high deflection rate by means of the coupling arrangement. By virtue of sufficiently high crash acceleration phenomena, an above-described deflection movement at such a deflection rate can cause the mass inertia of the blocking element to cause deflection into the blocking position beyond the deflection in accordance with normal operation, so that the blocking element blocks the continued operating movement of the functional element.

In terms of the energetic relationships, the solution according to the further teaching presents itself such that the blocking element is acted on by a deflection movement, which is associated with a corresponding movement energy, by virtue of every operating movement of the functional element by means of the functional element. This movement energy is then converted into potential energy in the element which provides the prestress, the said element preferably being a spring element. The degree of deflection accordingly depends on the level of movement energy and therefore on the deflection rate which, in the event of a crash, can be correspondingly high enough to reach the blocking position.

Depending on the design of the coupling element, movement energy can be applied as above to the blocking element by means of an impact between the functional element and the blocking element or by acceleration of the blocking element by the functional element, this acceleration being ramp-like or similar in relation to the deflection rate.

The first-mentioned teaching proposes, as discussed above, a latching arrangement which latches in when the blocking element is deflected into the blocking position and then holds the blocking element in the blocking position. This can ensure that the blocking element does not prematurely fall back into a blocking element starting position in the event of a crash. Rather, the blocking position of the blocking element is "stored" by the latching arrangement.

In a more particular embodiment, the functional element is the external operating lever of the motor vehicle lock. Therefore, the securing device can be integrated in the motor vehicle lock in a structurally particularly simple manner.

In further embodiments, the blocking element is equipped with a wire or strip which can be bent in a spring-elastic manner and is designated "spring element" in the text which follows. The structural implementation is particularly simple when the blocking element consists of the spring element alone.

Various advantageous variants are feasible for unlatching the latching arrangement. In a another embodiment, provision is made, in one variant, for operation of the internal door handle to unlatch the latching arrangement.

In other embodiments, a start of operation of the functional element is used to unlatch the latching arrangement. After the crash acceleration phenomena under discussion occur, the blocking element falls into its blocking position while, at the same time, the latching arrangement latches in. The latching arrangement is unlatched by way of a subsequent start of operation which is initially associated with blocking the operating movement. This allows for the situation of the probability of a double, crash-induced operating movement by the functional element to be virtually precluded.

In other embodiments, the latching arrangement is equipped with a blocking element contour, this leading to a structurally simple refinement of the entire arrangement.

The solutions can also be implemented with a securing device which, in the event of a crash, does not block the operating movement but rather converts the operating movement into a freewheeling movement. Accordingly, instead of the blocking element which can be deflected into a blocking position, a freewheeling element is provided, it being possible to deflect this freewheeling element into a freewheeling position in which an operating movement of the functional element can be converted into a freewheeling movement by the freewheeling element. In this case, the freewheeling element is, for example, a constituent part of a coupling in the dynamic chain which is associated with the functional element and is created in the event of a crash.

BRIEF DESCRIPTION OF THE DRAWINGS

The invention will be explained in greater detail below with reference to a drawing which illustrates only exemplary embodiments and in which

FIG. 6 shows the view according to FIG. 5 when the latching arrangement is latched in;

DETAILED DESCRIPTION

Figure 1:
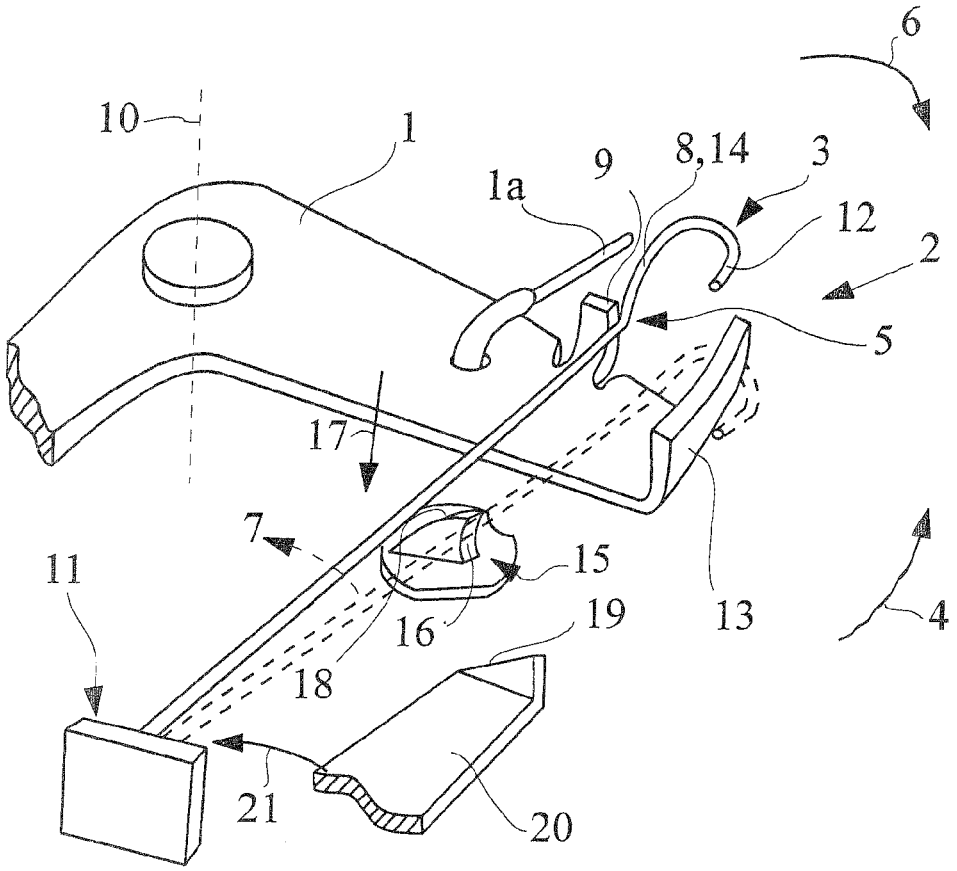
FIG. 1 shows the essential components of a securing device according to the proposal.

The motor vehicle lock arrangement in accordance with the teaching according to the proposal is equipped with a motor vehicle lock. The term "motor vehicle lock" includes, as already discussed in the introductory part of the description, all types of door, bonnet or flap locks.

Overview

In general, the invention relates to a motor vehicle lock arrangement having a motor vehicle lock, with an operable functional element and a securing device which is associated with the functional element, wherein the securing device is coupled or can be coupled to the functional element in order to counteract an automatic operating movement of the functional element due to crash acceleration phenomena which occur in the event of a crash. In one embodiment, the securing device has a deflectable blocking element which can be deflected into a blocking position in which an operating movement of the functional element can be blocked by the blocking element, and the blocking element has an associated latching arrangement which latches in when the blocking element is deflected into the blocking position, and the latched-in latching arrangement holds the blocking element in the blocking position. In a more particular embodiment, the motor vehicle lock has an external operating lever and/or an internal operating lever which is coupled or can be coupled to an external door handle or, respectively, an internal door handle in such a way that the motor vehicle lock can be opened, in particular a catch can be disengaged, by means of operating the external operating lever or internal operating lever, and the operable functional element, with which the securing device is associated, is the external operating lever and/or the internal operating lever. In another embodiment, the blocking element has a wire or strip which can be bent in a spring-elastic manner—spring element—, and the deflectability and the prestress of the blocking element are ensured by means of the spring elasticity of the spring element. In one embodiment, the spring element is of elongate design. In another embodiment, the spring element can be deflected substantially perpendicular to its longitudinal extent in order to ensure the deflectability of the blocking element. In one embodiment, the latched-in latching arrangement can be unlatched, and the unlatched latching arrangement releases the blocking element, preferably in that the arrangement is affected to the effect that the latching arrangement can be unlatched by operation of an internal door handle, in particular an internal operating lever or a lever which is coupled to the internal operating lever.

In another embodiment, the latching arrangement has a latching protrusion into which the spring element latches, when it is deflected into the blocking position, on account of its spring elasticity in a latching direction, and the latching engagement between the latching protrusion and the spring element can be disengaged by deflection of the spring element counter to the latching direction, and therefore the latching arrangement can be unlatched.

In another embodiment, a start of operation of the functional element, which follows the latching-in of the latching arrangement and is preferably performed from a starting position of the functional element, in particular during or after subsequent return of the functional element to its starting position, leads to the latching arrangement being unlatched.

In another embodiment, the blocking element can be moved to a blocking element starting position and to the blocking position and is held there in each case, in particular in a manner driven by spring force, and the blocking element can be moved to an intermediate adjustment region between the blocking element starting position and the blocking position and from there latches in the blocking element starting position in a manner driven by spring force provided that no holding measures for the blocking element are taken, preferably, during a start of operation when the blocking element is in the blocking position, the functional element engages with the blocking element and moves the blocking element into the intermediate adjustment region and holds it there, in any case until the operating movement is blocked, further preferably in that the functional element releases the blocking element in its blocking element starting position after the operating movement is blocked, in particular during or after return of the functional element to its starting position.

In another embodiment, the functional element has a holding element, in particular a hook-like holding element, which serves to hold the blocking element in the intermediate adjustment region while the operating movement is blocked by means of the blocking element.

In one embodiment, the latching arrangement has a blocking element contour with which the blocking element engages or can be moved into engagement, preferably in that the blocking element contour has a wedge bevel with a vertical extent and a transverse extent, and the wedge bevel is associated with the intermediate adjustment region of the blocking element, further preferably in that an upper starting support section which is associated with the blocking element starting position adjoins one end of the wedge bevel and a lower blocking support section which is associated with the blocking position adjoins the other end of the wedge bevel, in each case to support the blocking element against its spring prestress, further preferably in that the two support sections are oriented substantially perpendicular to one another in terms of the respective support direction, further preferably in that the starting support section is oriented in the vertical direction and the blocking support section is oriented in the transverse direction.

In another embodiment, the blocking element is prestressed or can be prestressed in the vertical and in the transverse direction, and an adjusting movement of the blocking element from the blocking position to the blocking element starting position accompanies spring stressing operations in the vertical direction and relieving of spring stress in the transverse direction, preferably in that the spring prestressing operations in the vertical and transverse direction are matched to one another such that the blocking element, which is located in the intermediate adjustment region and rests against the wedge bevel, falls into the blocking element starting position by sliding along the blocking element contour, provided that no holding measures for the blocking element are taken.

In another embodiment, crash acceleration phenomena which occur in the event of a crash trigger a transverse adjustment movement of the blocking element out of its blocking element starting position against its spring prestress in the transverse direction, and the blocking element then falls into the blocking position freely from the starting support section and in a manner driven by its spring prestress in the vertical direction.

In another embodiment, the blocking element has a wire or strip, and the wire or strip slides on the blocking element contour during a period of the adjustment movement of the blocking element, preferably the wire or strip—spring element—can be bent in a spring-elastic manner, and the deflectability and the prestress in the vertical and transverse direction are ensured by means of the spring elasticity of the spring element, further preferably in that the wire or strip which can be bent in a spring-elastic manner can be made to engage in a blocking manner with the functional element when the blocking element is in the blocking position.

In one embodiment, the securing device, instead of counteracting an automatic operating movement of the functional element due to crash acceleration phenomena which occur in the event of a crash, completely converts this operating movement of the functional element into a freewheeling movement, and accordingly, instead of the blocking element, which can be deflected into a blocking position, a freewheeling element is provided, it being possible to deflect this freewheeling element into a freewheeling position in which an operating movement of the functional element can be converted into freewheeling movement by the freewheeling element.

In another embodiment, the freewheeling element exhibits one or more of the features of the blocking element described above.

In another embodiment, the invention provides a motor vehicle lock arrangement having a motor vehicle lock, with an operable functional element and a securing device which is associated with the functional element, the securing device being coupled or it being possible to couple the securing device to the functional element in order to counteract an automatic operating movement of the functional element due to crash acceleration phenomena which occur in the event of a crash, wherein the securing device has a blocking element which can be deflected against a prestress, in particular against a spring prestress, and which can be deflected into a blocking position in which an operating movement of the functional element can be blocked by the blocking element, and the blocking element is coupled to the functional element at least in a movement region of the functional element by means of a coupling arrangement in such a way that an operating movement of the functional element causes a deflection movement of the blocking element against its prestress in the direction of the blocking position by means of the coupling arrangement, and during normal operation, an operating movement causes a deflection movement by means of the coupling arrangement without the blocking element reaching the blocking position, and, in the event of a crash, high crash acceleration phenomena can effect an automatic operating movement and therefore a deflection movement with a such a deflection rate by means of the coupling arrangement that the mass inertia of the blocking element effects deflection into the blocking position beyond the deflection experienced during normal operation, so that the blocking element blocks the continued operating movement of the functional element.

Now, with reference to the figures, the motor vehicle lock arrangement has an operable functional element 1 and also a securing device 2 which is associated with the functional element 1. The functional element 1 can be associated, for example, with the operating mechanism of the motor vehicle lock. In the illustrated, and in this respect preferred, exemplary embodiments, the functional element 1 is the external operating lever 1 of the motor vehicle lock which is coupled to an external door handle by means of a Bowden cable 1*a*.

The securing device 2 is coupled or can be coupled to the functional element 1 in order to counteract undesired, automatic operation of the functional element 1 by crash acceleration phenomena which occur in the event of a crash. In the case of the functional element 1 being designed in the form of an external operating lever 1, this ensures that the door or flap which is associated with the motor vehicle lock does not automatically open in the event of a crash.

The securing device 2 has a deflectable blocking element 3 which can be deflected from a blocking element starting position, against a prestress which is in the form of a spring prestress here, to a blocking position.

In this case, the terms "prestress" and "spring prestress" mean merely that the blocking element 3 is deflected against a prestressing force. The blocking element 3 can be fundamentally free of forces in the blocking element starting position and when the functional element 1 is not operated.

In a preferred refinement, a certain degree of play is provided between the functional element 1 and the blocking element 3 in the blocking element starting position and when the functional element 1 is not operated. However, it is also feasible for the blocking element 3, in its blocking element starting position and when the functional element 1 is not operated, to be in contact with the functional element 1 and, in particular, to press on the functional element 1 with a force. The last-mentioned variant is particularly advantageous in terms of avoiding rattling noises.

In the drawing, the blocking element 3 in its blocking element starting position is illustrated in solid lines and the blocking element 3 in the blocking position is illustrated in dashed lines. The design, which is still to be described in detail, of the functional element 1 on the one hand and of the blocking element 3 on the other shows that, when the blocking element 3 is in the blocking position, the operating movement 4 is blocked by the blocking element 3.

In the arrangement illustrated in FIG. 1, the blocking element 3 is preferably coupled to the functional element 1 by means of a coupling arrangement 5 which is still to be described. In this case, the arrangement is made such that an operating movement 4 of the functional element 1 leads, by means of the coupling arrangement 5, to a deflection movement of the blocking element 3 against its prestress in the direction of the blocking position. This coupling can also be provided only in a movement region of the functional element 1.

During normal operation, an operating movement 4 of the functional element 1, around to the left in FIG. 1, causes, by means of the coupling arrangement 5, a deflection movement 6 of the blocking element 3, towards the right in FIG. 1, but without the blocking element 3 reaching the blocking position. The deflection counteracts the spring stress of the blocking element 3, this deflection being indicated by reference symbol "7" in FIG. 1.

In the event of a crash, high crash acceleration phenomena can cause an automatic operating movement 4 of the functional element 1 and therefore, by means of the coupling arrangement 5, a deflection movement 6 of the blocking element at such a deflection rate that the mass inertia of the blocking element 3 causes deflection into the blocking position, which is illustrated in dashed lines, beyond the deflection in accordance with normal operation, so that the blocking element 3 blocks the continued operating movement 4 of the functional element 1.

In this case, the operating movement 4 of the external operating lever 1 causes a deflection of the blocking element 3 in the manner of forced coupling only as far as the deflection in accordance with normal operation which is upstream of the blocking position as seen from the blocking element starting position. In the case of a particularly fast deflection movement 6 which can be caused by a crash-induced, automatic operating movement 4 of the external operating lever 1, the deflection movement 6 is continued as far as the blocking position due to the mass inertia of the blocking element 3 against the prestress of the blocking element 3, this leading to the abovementioned blocking of the continued operating movement 4 of the functional element 1.

In the case of the refinement of the coupling arrangement 5 shown in FIG. 1, it is interesting that the coupling between the functional element 1 and the blocking element 3 is established only on one side. Specifically, the coupling arrangement 5 is preferably designed such that the blocking element 3 can be deflected in the direction of the blocking position substantially freely from the functional element 1 in a deflection region of the blocking element 3 at any rate. "Substantially freely" merely means that an adjusting movement of the blocking element 3 in the direction of the blocking position is not necessarily accompanied by an adjusting movement of the functional element 1, it being possible for a certain degree of coupling to remain between the functional element 1 and the blocking element 3, for example by means of an additional spring or the like. Accordingly, in the event of a crash, the blocking element 3 passes through the movement section between the deflection in accordance with normal operation and the blocking position in the above sense substantially freely of the functional element 1.

The fact that the deflection movement 6 takes place against the prestress of the blocking element 3 is vital to understanding the crash-induced deflection movement 6 of the blocking element 3. In this case, the extension of the deflection movement 6 is determined by the equilibrium of forces between the mass inertia force acting on the blocking element 3 and the spring force acting on the blocking element 3. It should be noted that "mass inertia force" in this case means the inertia force which originates from the deflection movement 6 of the blocking element 3 which is caused by the operating movement 4 of the functional element 1.

In the case of the solution according to the proposal, it is interesting that the prestress of the blocking element 3 can be selected to be so low that the reaction of the prestress to the functional element 1 is negligibly low during normal operation.

The described solution can be applied to all feasible types of motor vehicle locks and associated functional elements. However, in a preferred refinement, the motor vehicle lock is equipped with the customary locking elements, latch and pawl, with the operable functional element 1, with which the securing device 2 is associated, being the pawl or a pawl lever which is associated with the pawl. Reference may be made to DE 196 24 640 C1, which is cited in the introductory part of the description, in terms of the arrangement and the interaction of the latch and pawl. This also applies to the manner of operation of an external operating lever 1 or an internal operating lever as discussed above which may be associated with the motor vehicle lock.

An above-described external operating lever 1 of the motor vehicle lock is coupled or can be coupled to an external door handle, in particular, by means of a Bowden cable 1*a* in such a way that the motor vehicle lock can be opened, in particular the catch can be disengaged, by means of operating the external operating lever 1, with the operable functional element 1 preferably being the external operating lever 1. As an alternative or in addition to the external operating lever, an internal operating lever can be provided, the said internal operating lever being coupled or it being possible to couple the said internal operating lever to an internal door handle in a corresponding manner.

However, in principle, the securing device 2 according to the proposal can also be associated with a door handle, in particular an internal door handle or an external door handle, of the motor vehicle lock arrangement. In this case, the operable functional element 1, with which the securing device 2 is associated, is preferably a handle lever or the like of the respective door handle.

On account of the design of the system, provision is preferably made for the functional element 1, in the event of a crash, to initially carry out a first operating movement 4 before it is blocked by the blocking element 3. Accordingly, provision is preferably made for the functional element 1 to first run through a freewheeling process in the case of its operating movement 4 from the starting position illustrated in FIG. 1, and for the crash-induced blocking of the operating movement 4 of the functional element 1 to take place within the freewheel process. Accordingly, the freewheel process has to be designed such that there is no actual operation, for example disengagement of the catch, when the freewheel process is run through.

Various options for realizing the coupling arrangement 5 are feasible. In this case and preferably, the coupling arrangement 5 operates in the manner of a wedge mechanism.

The coupling arrangement 5 preferably has a guide contour on the functional element 1 or on the blocking element 3, and accordingly a guide element 9, which engages with or can be moved into engagement with the guide contour 8, on the blocking element 3 or on the functional element 1. In this case, the guide contour 8 is a shaped portion in the form of a wedge surface. It goes without saying that curved surfaces or the like are also possible here.

In the exemplary embodiment illustrated in FIG. 1 and preferred in this respect, the functional element 1 is designed as a pivotable lever which can be pivoted about a lever axis 10. The guide element 9, which here and preferably is designed as a lug or the like which projects from the functional element 1, is preferably arranged on the functional element 1 which is designed as a lever.

It goes without saying that numerous other refinements of the guide element 9 are feasible.

The drawing illustrates a very particularly advantageous refinement of the blocking element 3. Here and preferably, the blocking element 3 has a wire or strip which can be bent in a spring-elastic manner and, in the present case, is designated a "spring element", with the deflectability and the prestress of the blocking element 3 being ensured by means of the spring elasticity of the spring element 3. In the illustrated refinement, which can be realized in a particularly cost-effective manner, the blocking element 3 consists entirely of the spring element 3.

The advantage of the refinement of the blocking element 3 as a spring element is, in particular, that the prestress of the blocking element 3, as explained above, is self-generated by the resilient action of the blocking element 3. A separate spring element for realizing the prestress can therefore be dispensed with.

The spring element 3 is permanently mounted at a bearing point 11. In the case of a permanent bearing being realized for the spring element 3, the spring element 3 acts as a bending beam to some extent. However, during mounting, it can also be a flexible, possibly resilient, mounting.

Various preferred alternatives are feasible in terms of the choice of material for the spring element 3. In a particularly preferred refinement, the spring element 3 consists of a metal material, preferably spring steel. However, it may also be advantageous for the spring element 3 to be formed from a plastic material.

Various advantageous alternatives are also feasible for shaping the spring element 3. The spring element 3 preferably has a circular cross section. However, in particular from a production point of view, it may be advantageous to design the spring element 3 in the form of a belt or strip since such elements can be attached in a simple manner.

In the illustrated, and in this respect preferred, exemplary embodiments, the spring element 3 is designed to be straight in sections. In this case, the spring element 3 is preferably in the form of an integral wire which has the same spring-elastic properties over its entire length.

Very generally, the spring element 3 is preferably of elongate design, it being possible to deflect the spring element 3 as a whole substantially perpendicular to its longitudinal extent in order to ensure the deflectability of the blocking element 3.

The blocking engagement between the blocking element 3 and the functional element 1 can be realized in a particularly simple manner in the refinement of the blocking element 3 as a spring element. In this case, provision is preferably made for the spring element 3 to have a, here and preferably, hook-like section 12 for the blocking engagement with the operable functional element 1. For this purpose, the functional element 1 is equipped with a blocking lug 13 which, like the guide element 9, is realized as a bent lug.

The guide contour 8 discussed above can also be easily realized in the case of a blocking element 3 which is designed as a spring element. For this purpose, provision is preferably made for the spring element 3 to have an, in particular, bent section 14 which provides the guide contour 8 of the coupling arrangement 5. This can be clearly seen in the illustration in FIG. 1.

For the purpose of better understanding, both the sequence of operation in accordance with normal operation and the sequence in the event of a crash will be explained below with reference to the exemplary embodiment illustrated in FIG. 1.

Since the functional element 1 illustrated in FIG. 1 is the external operating lever 1 of the motor vehicle lock, the operation of an external door handle by a user is linked to an operating movement 4 of the external operating lever 1. In FIG. 1, this is a pivoting movement of the external operating lever 1 around to the left. During this operating movement 4, the guide element 9 of the external operating lever 1 runs along the guide contour 8 of the blocking element 3 and deflects the blocking element 3 slightly, in FIG. 1, to the right in the process. In the case of this slight deflection, the locking element 3 still does not yet engage with the blocking lug 13 of the external operating lever 1. During the entire operating movement 4, the blocking element 3 is pressed in the direction of the undeflected position by means of the prestress which is inherent in the spring element 3.

In the event of a crash, the speed or the acceleration of the operating movement 4 is several times higher than during normal operation. The guide element 9 runs along the guide contour 8 in this case too. As a result, a high speed of the blocking element 3 is set as early as in the first section of the operating movement 4, this speed being accompanied by a corresponding kinetic energy of the blocking element 3 (mass inertia). Given a sufficient speed, the mass inertia leads to the blocking element 3 reaching the blocking position against the spring force. The consequence is blocking of the continued operating movement 4 of the functional element 1.

The solution which is now proposed takes account of the fact that crash acceleration phenomena are far from deterministic. This concerns the direction, the time and the level of the crash acceleration phenomena. Therefore, the situation of a new crash acceleration phenomenon, which occurs during the return of the blocking element 3, not leading to the deflection of the blocking element 3 into the blocking position as is required per se is not precluded. In order to prevent this, the proposal makes provision for the blocking element 3 to have an associated latching arrangement 15 which latches in when the blocking element 3 is deflected into the blocking position, with the latching arrangement 15 which is latched in this way holding the blocking element 3 in the blocking position. Therefore, once the blocking element 3 falls into the blocking position, this position of the blocking element is effectively "stored".

In a preferred refinement, the latched-in latching arrangement 15 can also be unlatched, with the unlatched latching arrangement 15 again releasing the blocking element 3. This is primarily necessary in the event of a crash in order to be able to possibly free the occupants of the motor vehicle by means of operating the external operating lever.

In a particularly preferred refinement, the arrangement is made such that the latching arrangement 15 can be unlatched by operation of an internal door handle, in particular the internal operating lever or a lever which is coupled to the internal operating lever, of the motor vehicle lock. It is therefore possible to unlatch the latching arrangement 15 from the inside at any rate. Other variants for unlatching the latching arrangement 15 are feasible.

In the illustrated, and in this respect preferred, refinement of the blocking element 3 as the above-described wire- or strip-like spring element, the latching arrangement 15 can be realized in a very particularly simple manner. In this case and preferably, the latching arrangement 15 has a latching protrusion 16 which is arranged fixed to the housing and into which the spring element 3 latches, when it is deflected into the blocking position, on account of its spring elasticity in a latching direction 17.

FIG. 1 shows that an adjusting movement of the blocking element 3 from the blocking element starting position, which is illustrated in solid lines, to the blocking position, which is illustrated in dashed lines, is linked with a slight deflection of the spring element 3 counter to the latching direction 17 since the spring element 3 runs onto a run-on bevel 18. When the blocking position is reached, the spring element 3 latches into the latching protrusion 16 in the latching direction 17.

The fact that the latching engagement between the latching protrusion 16 and the spring element 3 can be disengaged again by slight deflection of the spring element 3 counter to the latching direction 17, and therefore the latching arrangement 15 can be unlatched in the above sense, is of particular importance in the above arrangement.

If, as proposed above, it is supposed to be possible to unlatch the latching arrangement 15 by operating the internal door handle or the internal operating lever, it is proposed that the internal operating lever or a lever which is coupled to the internal operating lever is equipped with a run-on bevel 19 which, when the internal door handle or the internal operating lever is operated, engages with the spring element 3 and deflects the spring element 3 counter to the latching direction 17. The internal operating lever is merely indicated in the drawing and has been provided with the reference symbol "20". The operating direction of the internal operating lever 20 is indicated by the reference symbol "21".

The above aspect of equipping the securing device 2 with a latching arrangement 15 is the subject matter of the teaching according to the proposal.

According to this teaching, it is essential that the securing device 2 has a deflectable blocking element 3 which can be deflected into a blocking position in which an operating movement 4 of the functional element 1 can be blocked by the blocking element 3. It is also essential that the blocking element 3 has an associated latching arrangement 15 which latches in when the blocking element 3 is deflected into the blocking position, and that the latched-in latching arrangement 15 holds the blocking element 3 in the blocking position.

How the blocking element 3 reaches the blocking position is of no importance in accordance with the teaching according to the proposal. In any case, all the above statements relating to a motor vehicle lock arrangement accordingly apply to the teaching according to the proposal.

Figure 2:
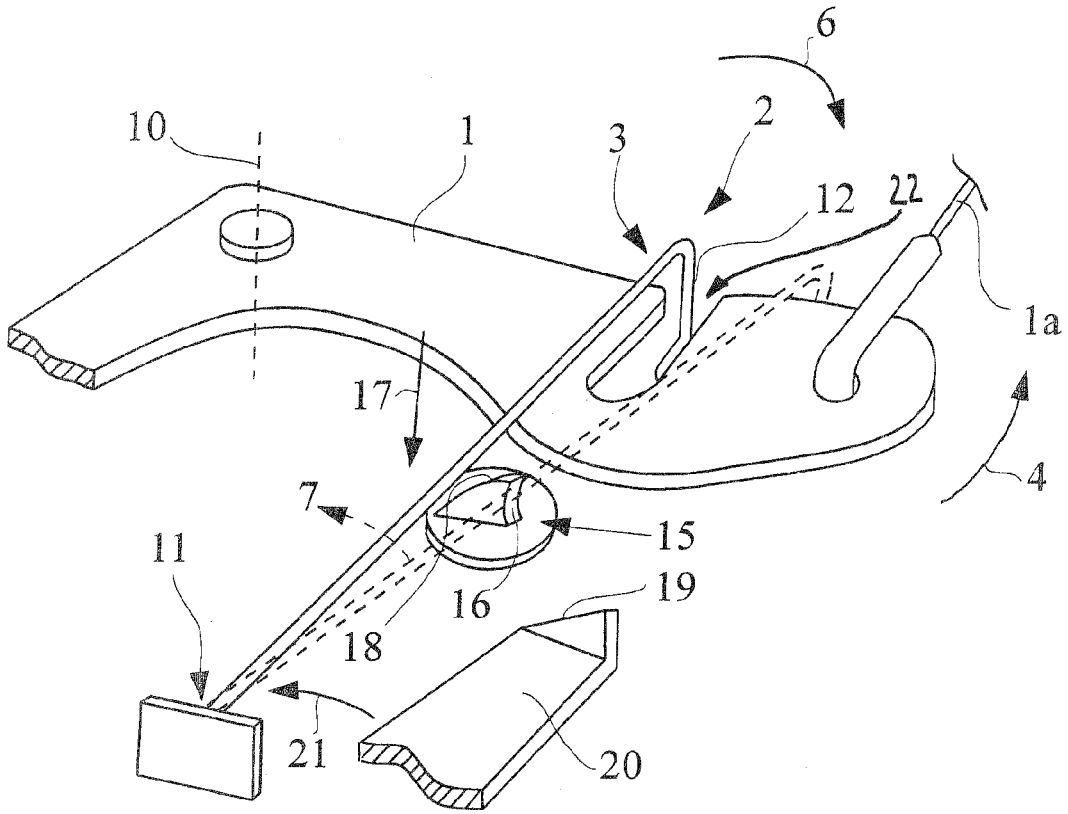
FIG. 2 shows the essential components of a further securing device according to the proposal.

As shown in the arrangement according to FIG. 2, it is possible, in particular, in accordance with the teaching according to the proposal to also dispense with an above-described coupling arrangement 5 between the functional element 1 and the blocking element 3. During normal operation, for example a hook-like section 12 of the blocking element 3 then runs in a slot 22 in the functional element 1. In the event of a crash, the blocking element 3 is deflected directly by the crash acceleration phenomena, so that the hook-like section 12 disengages from the slot 22 and blocks any possible operating movement 4 of the functional element 1. The functioning of the securing device 2 being dependent on the direction of the crash acceleration phenomena to a certain degree is accepted in this case in order to aid simple design.

FIGS. 3 to 7 show a particularly preferred refinement in which a start of operation of the functional element 1, which follows the latching-in of the latching arrangement 15 and is here and preferably performed from a starting position of the functional element 1, leads to the latching arrangement 15 being unlatched.

The latching-in of the latching arrangement 15 in this embodiment goes back on a mass inertia based movement of the blocking element 3 due to crash acceleration phenomena.

Figure 3:
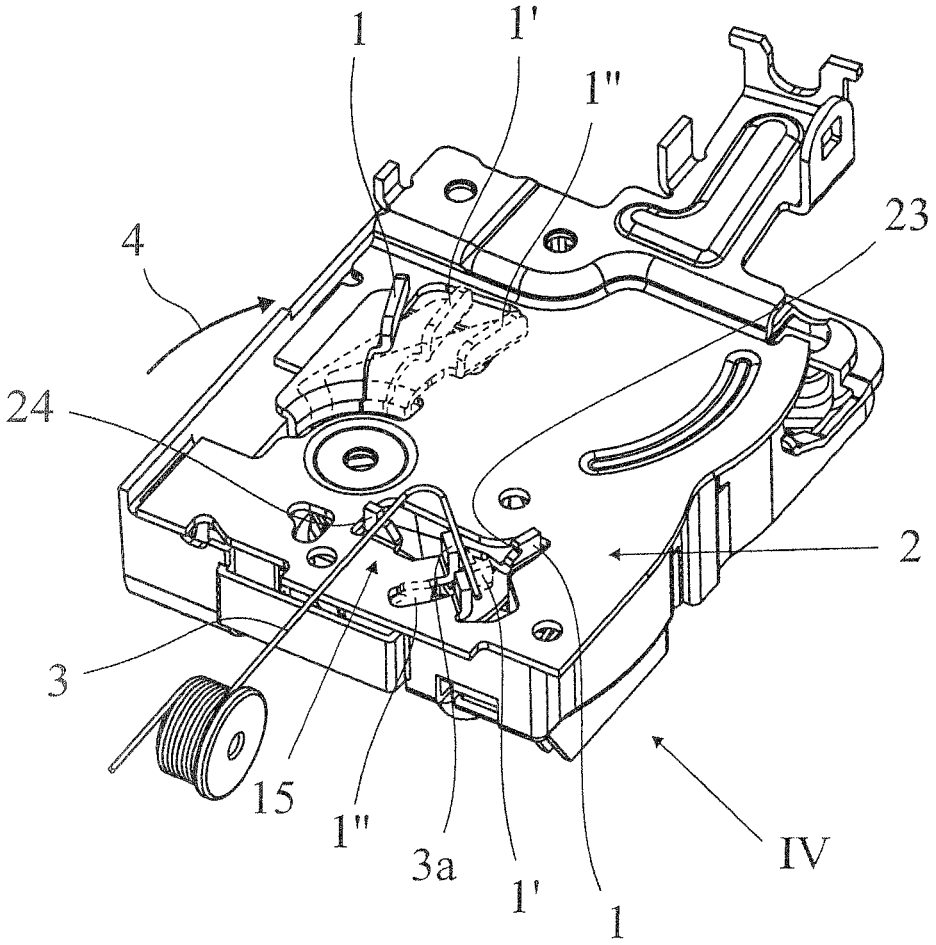
FIG. 3 shows a perspective view of a motor vehicle lock having a further securing device according to the proposal in use in accordance with normal operation.
Figure 4:
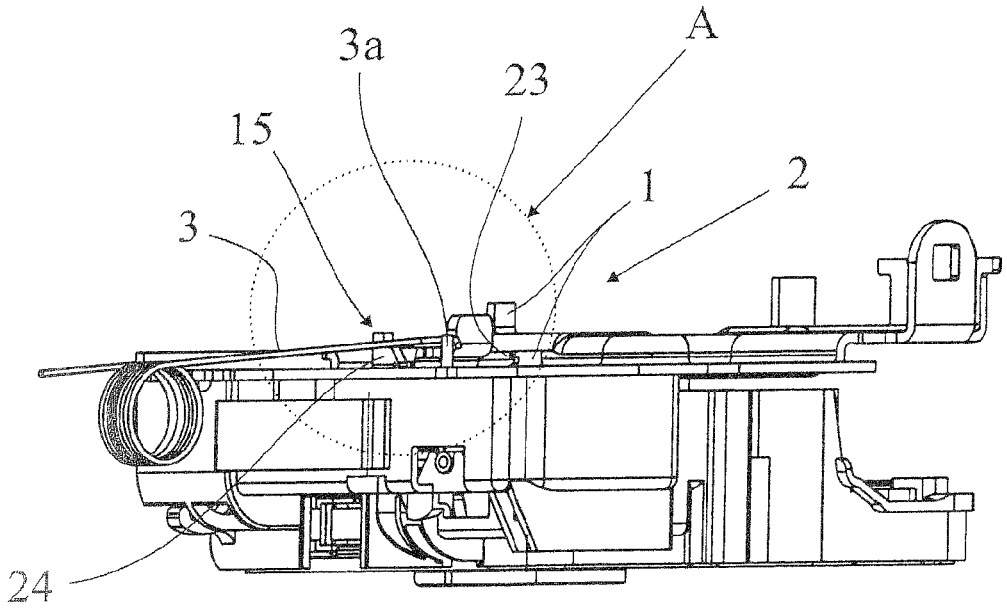
FIG. 4 shows the motor vehicle lock according to FIG. 3 from view IV.
Figure 5:
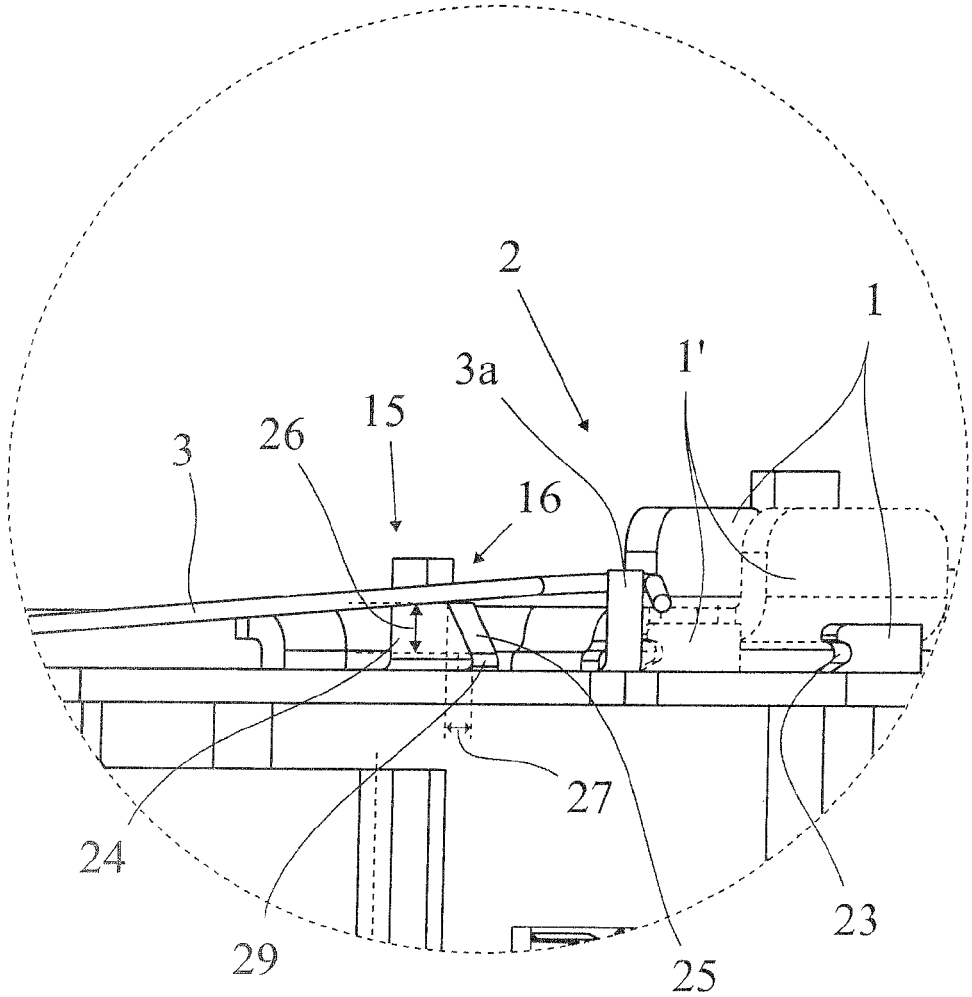
FIG. 5 shows the view of detail A according to FIG. 4 when in use in accordance with normal operation.

An operating movement 4 from the starting position can be seen for normal operation in the illustration according to FIG. 3 in which the functional element 1 is shown in the three positions 1, 1', 1" which correspond to the starting position, an intermediate position and the completely deflected position. When the latching arrangement 15 is latched in, the blocking effect of the securing device 2, which is still to be described, prevents a complete operating movement 4 but allows only a start of operation. This can be seen by looking at FIGS. 6 and 7 together. It should first be noted that the latching arrangement 15 is unlatched during or after the subsequent return of the functional element 1 to its starting position.

In this connection, it should also be noted that the start of operation which follows the latching-in of the latching arrangement 15 leads to unlatching of the latching arrangement 15 only after the operating movement 4 is blocked. This is necessary since, in this preferred variant, one-off blocking of the operating movement 4 is provided. The securing device 2 therefore effectively comprises a mechanical storage means which blocks the first operating movement 4 after latching in of the latching arrangement 15 and handles the subsequent operating movement 4 in accordance with normal operation. The structural refinement illustrated in FIGS. 3 to 7 shows a particularly simple implementation of such a mechanical storage means.

Figure 6:
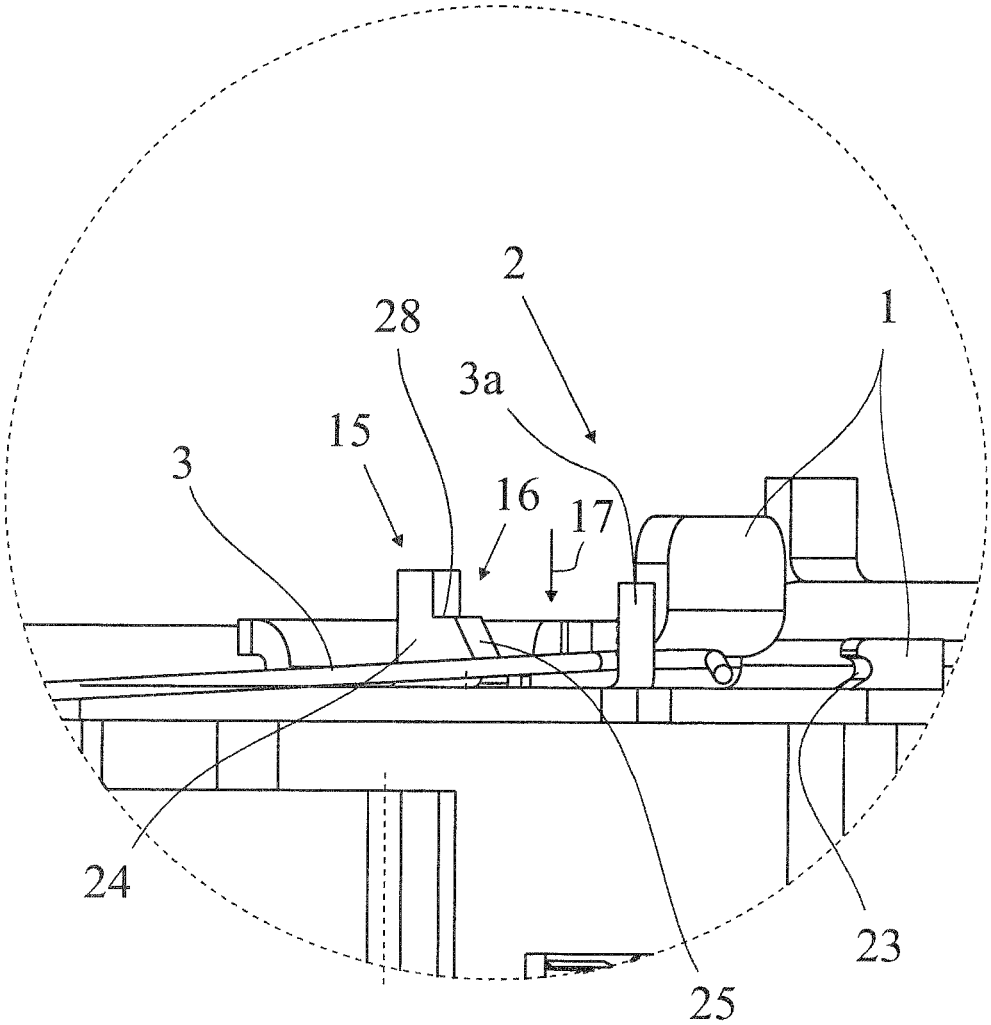

The blocking element 3 preferably can be moved into a blocking element starting position (FIGS. 3, 4, 5) and into the blocking position (FIG. 6). The blocking element 3 is held in the respective positions, in particular in a manner driven by spring force. This is achieved by the locking element 3 being supported in each case at corresponding support points which are still to be described.

It is interesting that, in this case, the blocking element 3 can be moved to an intermediate adjustment region (FIG. 7) which is situated between the blocking element starting position (FIGS. 3, 4, 5) and the blocking position (FIG. 6), and from there latches in the blocking element starting position in a manner driven by spring force, provided that no holding measures for the blocking element 3 which are still to be described are taken. The adjusting movement of the blocking element 3 from the blocking position illustrated in FIG. 6 to the intermediate position illustrated in FIG. 7 therefore leads to the blocking element 3 falling into the blocking element starting position, provided that it is not held in some other way.

Figure 7:
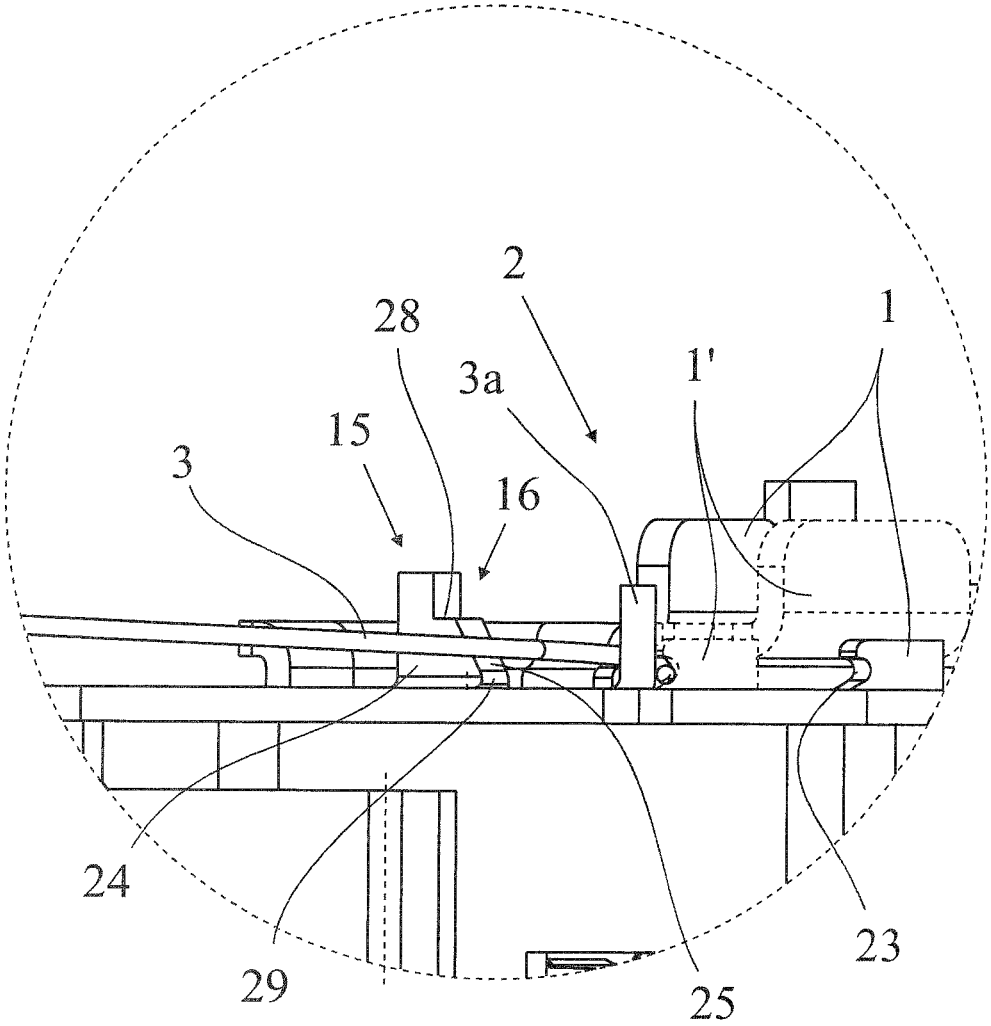
FIG. 7 shows the view according FIG. 5 when the blocking element is in the intermediate adjustment region.

During a start of operation when the blocking element 3 is in the blocking position, the functional element 1 preferably engages with the blocking element 3 and moves the blocking element 3 into the intermediate adjustment region, as can be seen by looking at FIGS. 6 and 7 together. It is important here that the functional element 1 is designed such that it holds the blocking element 3 in the intermediate adjustment region during the entire blocking process. The blocking element 3 is released in its blocking element starting position (FIG. 5) after the operating movement 4 is blocked, here during and in each case after return of the functional element 1 to its starting position.

The start of operation of the functional element 1 itself therefore ensures that the blocking element 3 is moved to the intermediate adjustment position. Accordingly, provision is made for the blocking element 3 to also block the operating movement 4 of the functional element 1 in the intermediate adjustment region. The functional element 1 is, here and preferably, equipped with a holding element 23, further preferably with a hook-like holding element 23, in order to hold the blocking element 3 in the intermediate adjustment region while the operating movement 4 is blocked. This holding element 23 engages, as shown in FIG. 7, with the blocking element 3 which is, here and preferably, in the form of a wire.

The core piece of the latching arrangement 15 shown in FIGS. 3 to 7 consists of a blocking element contour 24 with which the blocking element 3 engages or can be moved into engagement, as can be seen in the drawing.

In the illustrated refinement, the blocking element contour 24 has a wedge bevel 25 which is associated with the above-described intermediate adjustment region of the blocking element 3. The wedge bevel 25 is defined by means of a vertical extent 26 and a transverse extent 27 in the customary manner. An upper starting support section 28 which is associated with the blocking element starting position adjoins one end of the wedge bevel 25, and a lower blocking support section 29 which is associated with the blocking position of the blocking element 3 adjoins the other end of the said wedge bevel. The two support sections 28, 29 in each case serve to support the blocking element 3 against its spring prestress which is still to be described. At this point, it is only important that the two support sections 28, 29 are oriented substantially perpendicular to one another in terms of their respective support direction. The starting support section 28 specifically supports the blocking element 3 in the vertical direction, while the blocking support section 29 supports the blocking element 3 substantially in the transverse direction.

The fact that the blocking element 3 is prestressed or at any rate can be prestressed both in the vertical direction and in the transverse direction is then of particular importance. The direction of the prestress can be best described by an adjusting movement of the blocking element 3 from the blocking position (FIG. 6) to the blocking element starting position (FIGS. 3, 4, 5) since this adjusting movement accompanies spring stressing in the vertical direction and spring stress relief in the transverse direction. The blocking element 3 is therefore prestressed in the downward direction and is or can be prestressed to the left in FIG. 3.

Correct matching of the spring prestresses in the vertical and transverse direction is of very particular importance in the present case. The said prestresses are preferably matched to one another such that the blocking element 3, which is located in the intermediate adjustment region and rests against the wedge bevel 25, falls into the blocking element starting position by sliding along the blocking element contour 24, as described above, provided that the holding measures which can be traced back to the functional element 1 are not taken into consideration. The above matching is essential for functioning since the prestress of the blocking element 3 in the vertical direction counteracts automatic latching in of the blocking element 3 in its blocking element starting position.

In the event of a crash, the crash acceleration phenomena, given a corresponding design, ensure transverse adjusting movement of the blocking element 3, in FIG. 3, to the right against its spring prestress in the transverse direction. In this case, the blocking element 3 temporarily disengages from the blocking element contour 24, so that the blocking element 3 then falls into the blocking position, which is illustrated in FIG. 6, freely from the starting support section 28 and in a manner driven by its spring prestress in the vertical direction. The blocking element 3 is supported against the blocking support section 29 there. If a start of operation is now started by the functional element 1, the functional element 1 engages by way of its holding element 23 with the blocking element 3 so as to provide blocking. In this case, the functional element 1 compresses the blocking element 3 in such a way that the blocking element 3 reaches its intermediate adjustment region (FIG. 7). Here the functional element 1 simply pushing up the blocking element 3 is possible as well. For the purpose of effective blocking, the blocking element 3 has an associated mating bearing 3*a*.

While the operating movement 4 is blocked, the hook-like holding element 23 ensures that the blocking element 3 cannot fall into its blocking element starting position. However, as soon as the functional element 1 is returned in the direction of its starting position, the blocking element 3 is released and slides on the wedge bevel 25, in a manner driven by its spring prestress in the transverse direction, into its blocking element starting position.

It has already been noted that the blocking element 3, here and preferably, has a wire or strip, with the wire or strip sliding on the blocking element contour 24 during a period of the adjusting movement of the blocking element 3. In a particularly preferred refinement, the wire or strip, as likewise already discussed, can be bent in a spring-elastic manner, so that the deflectability and the spring prestress overall in the vertical and transverse direction are ensured by means of the spring elasticity of the blocking element 3 which here forms a spring element 3.

It is clear here that the above-described spring prestresses are the components of the total spring prestress in the vertical and transverse direction. However, it is also feasible, in principle, for the spring prestresses in the vertical and transverse direction to be realized by two separate spring elements. Accordingly, provision may also be made for the blocking element 3 to be designed as a rigid, inflexible wire or strip or to have such a wire or strip.

It is also interesting in the case of the exemplary embodiment illustrated in FIGS. 3 to 7 that the wire or strip which can be bent, here and preferably, in a spring-elastic manner can be moved into engagement in a blocking manner with the functional element 1 when the blocking element 3 is in the blocking position. Therefore, the blocking element 3 has a double function in this respect.

It should also be noted that the blocking element 3 is routinely equipped with a mass element which is not illustrated here and with which the mass inertia based movement of the blocking element 3 due to crash acceleration phenomena may be controlled. Given a corresponding design, the mass inertia of the blocking element 3 itself is sufficient to deflect the blocking element 3 in the above-described manner in the event of a crash.

It has already been explained in the general part of the description that the functional element 1 does not necessarily have to be blocked in all the solutions according to the proposal. Therefore, in a particularly preferred refinement, provision is made for the securing device 2, instead of counteracting an automatic operating movement 4 of the functional element 1 due to crash acceleration phenomena which occur in the event of a crash, to completely convert this operating movement 4 of the functional element 1 into a freewheeling movement, and accordingly for a freewheeling element 30 to be provided instead of the blocking element 3 which can be deflected into a blocking position.

It is essential here for it to be possible to deflect this freewheeling element 30 into a freewheeling position in which an operating movement 4 of the functional element 1 can be converted into a freewheeling movement by the freewheeling element 30. All the above statements which do not expressly relate to a blocking mechanism for the operating movement 4 correspondingly apply to the embodiments with a freewheeling element 30.

Figure 8:
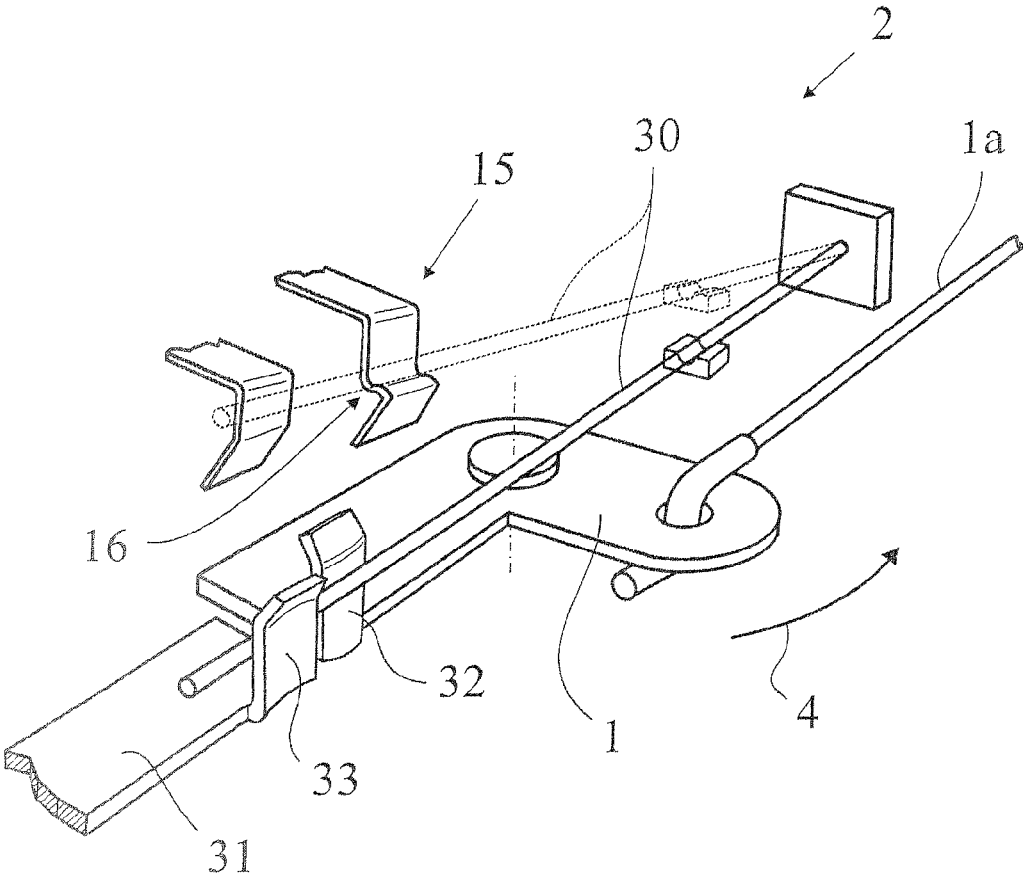
FIG. 8 shows the essential components of a further securing device according to the proposal.

A simple example of a refinement of the teaching according to the proposal with a freewheeling element 30 is shown in FIG. 8. The basic design with an internal operating lever 1 and a Bowden cable 1*a* corresponds to the arrangement illustrated in FIG. 1. In this case, the functional element 1 has an associated connection lever 31 which follows a movement of the functional element 1 during normal operation and passes on the operating movement of the functional element 1 to the motor vehicle lock. The freewheeling element 30 is also provided, this establishing a coupling between the functional element 1 and the connection lever 31 during normal operation. For this purpose, corresponding coupling lugs 32, 33 which project upward in the plane of the drawing are provided on the functional element 1 and on the connection lever 31.

In the event of a crash, the freewheeling element 30 is deflected upward in FIG. 8, so that the coupling lug 32 of the functional element 1 disengages from the freewheeling element 30. Accordingly, the functional element 1 executes a freewheeling operation when it is operated. This illustration shows that it is of absolutely no importance to the solution according to the proposal whether the operating movement is decoupled according to FIG. 8 or blocked according to FIGS. 1 to 7, and therefore it should once again be noted that all the above solutions with a blocking element 3 can be applied to the solution with a freewheeling element 30 and can be claimed as such.

The latching arrangement 15 may be realized in various ways. The latching-in may for example go back on a clamping of the blocking element 3. Also it may be possible to use deflections of the blocking element 3, which has a wire or strip, to keep the blocking element 3 in latching engagement. Any possible deforming of the blocking element 3, in particular bending and/or torsion, is possible.

Finally, it should also be noted that, as discussed above, it does not matter how the blocking element 3 or the freewheeling element 30 is or are deflected. The only important factor is that the respective deflection can be triggered by crash acceleration phenomena which can, in principle, lead to an automatic operating movement of the functional element 1.

The invention claimed is:

1. A motor vehicle lock arrangement having a motor vehicle lock, with an operable functional element and a securing device which is associated with the functional element in order to counteract an operating movement of the functional element due to crash acceleration phenomena which occur in the event of a crash, wherein the securing device has a deflectable blocking element which can be deflected away from a starting position by the crash acceleration phenomena such that the blocking element is driven into a blocking position by a spring prestress, wherein in the blocking position, the operating movement of the functional element can be blocked by the blocking element, wherein the blocking element has an associated latching arrangement which holds the blocking element in the blocking position when the cooperation between the blocking element and the latching arrangement is in a latched state, wherein the blocking element is an elongated spring element, wherein the elongated spring element comprises a wire or strip which can be bent in a spring-elastic manner, and the deflectability and the spring prestress of the blocking element are provided by a spring elasticity of the elongated spring element, and wherein the wire or strip slides on a blocking element contour of the latching arrangement during a period of an adjustment movement of the blocking element along the blocking element contour toward the starting position.

2. A motor vehicle lock arrangement according to claim 1, wherein the motor vehicle lock has an external operating lever, an internal operating lever, or a combination thereof which is coupled or can be coupled to an external door handle or, respectively, an internal door handle in such a way that the motor vehicle lock can be opened by operating the external operating lever or internal operating lever, and the operable functional element, with which the securing device is associated, is the external operating lever, the internal operating lever, or a combination thereof.

3. A motor vehicle lock arrangement according to claim 1, wherein the cooperation between the blocking element and the latching arrangement can be placed in an unlatched state such that the blocking element is released from the blocking position.

4. A motor vehicle lock arrangement according to claim 1, wherein the start of the operating movement of the functional element, which follows the placing of the cooperation between the blocking element and the latching arrangement in the latched state, leads to the cooperation between the blocking element and the latching arrangement being in an unlatched state.

5. A motor vehicle lock arrangement according to claim 1, wherein the blocking element is held in the starting position and the blocking position, and the blocking element can be moved to an intermediate adjustment region between the starting position and the blocking position and from there the blocking element is held in the starting position by the spring prestress provided that no holding measures for the blocking element are taken.

6. A motor vehicle lock arrangement according to claim 1, wherein the functional element has a holding element, which serves to hold the blocking element in an intermediate adjustment region between the starting position and the blocking position while the operating movement of the functional element is blocked by the blocking element.

7. A motor vehicle lock arrangement according to claim 1, wherein the latching arrangement has a wedge bevel that is associated with an intermediate adjustment region of the blocking element between the starting position and the blocking position.

8. A motor vehicle lock arrangement according to claim 1, wherein the spring prestress that drives the blocking element into the blocking position is in a vertical direction, wherein the spring prestress is or can be in a transverse direction, and wherein the adjustment movement of the blocking element along the blocking element contour toward the starting position increases the spring prestress in the vertical direction and relieves the spring prestress in the transverse direction.

9. A motor vehicle lock arrangement according to claim 1, wherein the spring prestress that drives the blocking element into the blocking position occurs in a vertical direction, wherein the spring prestress can also occur in a transverse direction, and wherein the crash acceleration phenomena trigger a transverse adjustment of the blocking element out of the starting position against the spring prestress in the transverse direction, and the blocking element is then driven into the blocking position from a starting support section of the latching arrangement by the spring prestress in the vertical direction.

* * * * *